US007770504B2

(12) United States Patent
Tippmann, Sr. et al.

(10) Patent No.: US 7,770,504 B2
(45) Date of Patent: Aug. 10, 2010

(54) APPARATUS AND METHOD FOR FIRING A PROJECTILE

(75) Inventors: Dennis J. Tippmann, Sr., New Haven, IN (US); Dennis J. Tippmann, Jr., Fort Wayne, IN (US)

(73) Assignee: Tippmann Sports, LLC, Fort Wayne, IN (US)

( * ) Notice: Subject to any disclaimer, the term of this patent is extended or adjusted under 35 U.S.C. 154(b) by 760 days.

(21) Appl. No.: 11/202,814

(22) Filed: Aug. 12, 2005

(65) Prior Publication Data

US 2006/0032487 A1 Feb. 16, 2006

Related U.S. Application Data

(60) Provisional application No. 60/601,044, filed on Aug. 12, 2004.

(51) Int. Cl.
*F41A 1/04* (2006.01)
*F41B 11/00* (2006.01)

(52) U.S. Cl. ..... 89/7; 124/56; 124/74

(58) Field of Classification Search ..... 89/7; 124/56–77

See application file for complete search history.

(56) References Cited

U.S. PATENT DOCUMENTS

| | | | | | |
|---|---|---|---|---|---|
| 645,932 | A | * | 3/1900 | Beck et al. | 89/125 |
| 1,164,876 | A | | 12/1915 | Sayler | |
| 1,166,837 | A | | 1/1916 | Kelly | |
| 1,291,674 | A | | 1/1919 | Brannon | |
| 1,359,295 | A | * | 11/1920 | Trumble | 89/7 |
| 1,375,653 | A | * | 4/1921 | McLain et al. | 89/1.1 |
| 1,383,111 | A | * | 6/1921 | Hall et al. | 89/7 |
| 1,653,171 | A | * | 12/1927 | Hagen | 89/1.1 |
| 2,129,875 | A | * | 9/1938 | Rost | 89/7 |
| 3,202,055 | A | | 8/1965 | Butler et al. | |
| 3,228,298 | A | * | 1/1966 | Grandy et al. | 89/16 |
| 3,255,669 | A | | 6/1966 | Olofsson | |
| 3,343,455 | A | | 9/1967 | Lohr | |
| 3,346,984 | A | | 10/1967 | Lohr | |
| 3,571,962 | A | * | 3/1971 | Eig | 42/76.02 |
| 3,673,917 | A | * | 7/1972 | Myers | 89/7 |

(Continued)

FOREIGN PATENT DOCUMENTS

| | | |
|---|---|---|
| JP | 60104806 | 6/1985 |
| JP | 4136696 | 5/1992 |
| JP | 5215492 | 8/1993 |
| JP | 6185894 | 7/1994 |

OTHER PUBLICATIONS

"Paintball Cannon"—Apr. 10, 2001; at http://www.geocities.com/pomanspaintball/cannon.html.

*Primary Examiner*—Troy Chambers
(74) *Attorney, Agent, or Firm*—Barnes & Thornburg LLP

(57) ABSTRACT

Apparatus for firing a projectile comprises a receiver, a barrel, a supply of combustible gas, a combustion chamber, a valve arrangement for controlling flow of combustible gas from the supply to the combustion chamber, an igniter, and a passageway for directing combustion gases from the chamber to propel a projectile from the apparatus. In one embodiment, the barrel has a longitudinally-extending central axis, and the combustion chamber is disposed laterally adjacent the axis. A method of operating the apparatus comprises the steps of providing a combustible mixture of gas and air to the combustion chamber, igniting the mixture so as to generate combustion gases, allowing pressure in the combustion chamber to increase to a predetermined level, and releasing the gases from the combustion chamber and directing the gases to propel the projectile through the barrel.

65 Claims, 15 Drawing Sheets

U.S. PATENT DOCUMENTS 3,728,937 A 4/1973 Nelson et al.
3,803,975 A * 4/1974 Elmore et al. ..... 89/7
4,043,248 A 8/1977 Bulman et al.
4,109,557 A 8/1978 Zaucha
4,161,133 A 7/1979 Black et al.
4,365,471 A 12/1982 Adams
4,377,991 A 3/1983 Liesse
4,510,748 A 4/1985 Adams
4,616,622 A 10/1986 Milliman
4,665,868 A 5/1987 Adams
RE32,452 E 7/1987 Nikolich
4,712,379 A 12/1987 Adams
4,759,318 A 7/1988 Adams
4,821,683 A 4/1989 Veldman
4,852,459 A 8/1989 Bulman
4,905,634 A 3/1990 Veldman
4,949,621 A 8/1990 Stephens
5,125,320 A 6/1992 Zielinski
5,199,626 A 4/1993 Terayama et al.
5,212,328 A * 5/1993 Petrovich ..... 42/76.02
5,257,614 A 11/1993 Sullivan
5,333,594 A 8/1994 Robinson
5,349,939 A * 9/1994 Perrone ..... 124/76
5,361,700 A 11/1994 Carbone
5,377,628 A 1/1995 Adams
5,398,591 A * 3/1995 Gay ..... 89/33.03
5,462,042 A 10/1995 Greenwell
5,499,567 A 3/1996 Gay
5,511,333 A 4/1996 Farrell
5,540,194 A 7/1996 Adams
5,613,483 A 3/1997 Lukas et al.
5,660,407 A 8/1997 Adams
5,769,066 A 6/1998 Schneider
5,771,621 A * 6/1998 Rogers ..... 42/55
5,771,875 A 6/1998 Sullivan
5,845,629 A 12/1998 Ratliff
D410,182 S 5/1999 Etter et al.
5,944,502 A * 8/1999 Denchfield ..... 431/1
5,967,133 A 10/1999 Gardner et al.
5,988,153 A 11/1999 Yoshimura
6,003,504 A 12/1999 Rice et al.
6,006,704 A 12/1999 Phillips et al.
6,016,945 A 1/2000 Phillips et al.
6,016,946 A 1/2000 Phillips et al.
6,019,072 A 2/2000 Phillips et al.
6,138,656 A 10/2000 Rice et al.
6,233,928 B1 5/2001 Scott
6,324,779 B1 * 12/2001 Tippmann, Jr. ..... 42/76.01
6,343,599 B1 2/2002 Perrone
6,371,099 B1 4/2002 Lee
6,418,920 B1 7/2002 Marr
6,474,326 B1 11/2002 Smith et al.
6,491,002 B1 12/2002 Adams
6,634,325 B1 10/2003 Adams
6,647,969 B1 11/2003 Adams
6,755,159 B1 6/2004 Adams et al.
7,337,774 B2 * 3/2008 Webb ..... 124/60
2002/0088449 A1 7/2002 Perrone
2002/0108585 A1 8/2002 Davis
2002/0134069 A1 9/2002 Adams
2002/0134345 A1 9/2002 Adams
2002/0144498 A1 10/2002 Adams
2003/0005918 A1 1/2003 Jones
2003/0034020 A1 * 2/2003 Irizarry et al. ..... 124/56
2003/0110758 A1 6/2003 Adams
2003/0131809 A1 7/2003 Adams
2004/0031382 A1 2/2004 Ogram
2004/0144012 A1 7/2004 Adams
2004/0144357 A1 7/2004 Adams
2007/0175324 A1 * 8/2007 Adams ..... 89/7

* cited by examiner

APPARATUS AND METHOD FOR FIRING A PROJECTILE

RELATED APPLICATION

This application is related to and claims priority to U.S. Provisional Patent Application Ser. No. 60/601,044, filed on Aug. 12, 2004, titled Apparatus and Method for Firing a Projectile which is hereby expressly incorporated into this application by this reference thereto.

FIELD OF THE INVENTION

The present invention relates generally to methods and apparatus for firing projectiles using combustible gas-powered devices. In certain embodiments, the present invention relates more specifically to paintball markers and to methods for and devices capable of firing paintballs, or other projectiles having characteristics similar to paintballs, using a combustible gas.

BACKGROUND

Currently, the state of the art for firing a frangible projectile typically involves the use of compressed gas. Compressed gas is released to fire a projectile from an apparatus using the expansion of the gas to propel the projectile. In addition to frangible projectiles, such as paintballs, other non-lethal projectiles (BBs, pellets, air-soft pellets/BBs, darts, etc.) are also fired from devices powered by compressed gases, such as carbon dioxide and air.

Paintball markers are primarily used for paintball gaming. In paintball gaming, a player normally carries a paintball marker typically outfitted with a compressed gas tank and a hopper containing a supply of paintballs. It is not unusual for a player to carry an additional supply of paintballs for use, as well as extra compressed gas tanks. Currently, compressed gas tanks, such as $CO_2$ tanks, are limited to a relatively small number of shots. As paintball marker technology has developed, the firing rates of markers have increased, thereby requiring more compressed gas. Since tank size is limited, players are required to carry extras for a lengthy game session. Increasing substantially the number of shots-per-tank would reduce or eliminate the need to carry extra tanks. Such an increase would also reduce time spent on changing tanks in the field and/or on refilling tanks for subsequent use.

SUMMARY

The present invention will be described in connection with an illustrative embodiment of a paintball marker, or paintball gun, designed to fire a .68 caliber paintball. While the subject invention offers several advantages in the context of this type of paintball marker, the principles of the invention can be adapted to devices for firing other projectiles, particularly loose fitting projectiles (such as spark balls or frangible projectiles filled with liquids, powders or other substances). The principles embodied in the invention may also be used in devices designed to fire traditional pellets and BBs, non-traditional varieties of these projectiles, and other types of projectiles, as well.

In one illustrative embodiment, a paintball marker fires paintballs through the use of combustible gas. This embodiment includes a combustion chamber into which combustible gas and fresh air are drawn. These two are mixed together and subsequently a triggering mechanism is activated to ignite the mixture of combustible gas and fresh air. The combustion gases are directed to an area in the paintball receiver where the paintball is disposed. The combustion gases push the paintball out of a barrel attached to the paintball marker. This illustrative embodiment also includes a piston, which when actuated in one direction moves through the combustion chamber and any exhaust gases. When the piston is actuated in an opposite direction, the piston pushes the exhaust gases out of the combustion chamber and draws in fresh air and more combustible gas for combustion. The piston is shaped to conform to the internal surface of the combustion chamber allowing substantially all of the exhaust gases to be exhausted as the piston cycles through the combustion chamber.

In another illustrative embodiment, a paintball marker includes a second piston and a biasing member. The second piston is actuated by pressure created through combustion; however, the actuation is resisted due to the biasing member. The biasing member can be adjusted to allow the piston to be actuated at certain pressures created through combustion. When the piston is actuated, the combustion gases are provided access to a passageway connected to an area in which a paintball is disposed. When the combustion gases flow through the passageway, the pressurized gases propel the paintball from the barrel of the paintball marker. In another illustrative embodiment, the length of the passageway is kept relatively short to improve the operation of the marker.

In certain embodiments, the combustion chamber is positioned laterally adjacent the centerline of the barrel. That is, the combustion chamber is positioned beside, rather than in line with, the barrel. In such embodiments, an opening is formed in a sidewall of the barrel, or in a portion of the receiver which is generally aligned with the barrel, to admit pressurized gases from the combustion chamber which are then used to propel a projectile through the barrel. This arrangement facilitates reducing the length of the passageway through which such pressurized gases are conducted. This arrangement further assists in reducing the overall length of the receiver portion of a paintball marker. The opening in the receiver/barrel is preferably disposed relatively close to the point at which the projectile enters the receiver/barrel.

In another illustrative embodiment, a paintball marker includes a barrel formed of a non-metallic material, such as fiberglass or plastic. The non-metallic barrel inhibits condensation which can form in metallic barrels due to the combustion gases coming into contact with the interior surface of a metallic barrel. The inhibition of condensation reduces potentially adverse impacts upon the trajectory of projectiles which might otherwise occur if substantial condensation occurs in the barrel. In certain embodiments, the entire barrel may be formed of a non-metallic material or, alternatively, a portion of the barrel is so-formed. For example, an aluminum barrel may be provided with a non-metallic liner to inhibit or reduce condensation.

In another illustrative embodiment, the combustion chamber is cylindrically shaped and includes a plurality of cooling fins located on the exterior of the combustion chamber. The cooling fins are disposed longitudinally along the combustion chamber.

In another illustrative embodiment, a paintball marker includes a grip and receiver integrally formed with one another. The grip and receiver are formed to include a cavity which forms or receives a combustion chamber. Reinforcing brackets or clips may be provided to reduce any adverse effects on marker components created by the forces of combustion generated within the combustion chamber. For example, reinforcing clips may be provided adjacent an igniter-receiving opening in the combustion chamber to resist forces acting to push the igniter out of the opening and against other components of the marker.

An illustrative embodiment of a paintball marker includes an igniter disposed in the combustion chamber. The igniter is disposed adjacent one end of the combustion chamber. A port for introducing combustion gases is located in an opposite end of the combustion chamber. This configuration promotes efficient combustion, thereby increasing pressures and projectile velocity. In certain embodiments, the igniter is preferably disposed in an end of the combustion chamber generally opposite, and relatively far from, the opening in the receiver/barrel through which the pressurized gases flow to propel the ball from the barrel.

The specific embodiments described are intended to illustrate the principles of operation only, and are not intended as being the only embodiments contemplated. Specifically, the illustrative embodiments described in detail are manually-operated, pump-type paintball markers. That is, the embodiments are cycled between an uncocked or idle position and a cocked or ready-to-fire position by means of a manually-operated sliding member. However, an automatic or semi-automatic cocking arrangement can also be provided. Automatic cocking arrangements for paintball markers (and like devices) are known. For example, U.S. Pat. No. 5,503,137 discloses a kit for converting a pump-action type compressed gas-powered marker to a semi-automatic marker. An electric, motor-driven rack and pinion assembly may also be used to cycle the device. A portion of the pressurized gas generated in the combustion chamber can also be "diverted" (as is commonly done in $CO_2$-powered devices) to "cock" the device and ready it for a subsequent firing. The principles employed by such known techniques may be employed in an automatic cocking embodiment of a device which incorporates the present invention (i.e., which is powered by a combustible gas).

DETAILED DESCRIPTION OF THE DRAWINGS

Figure 1:
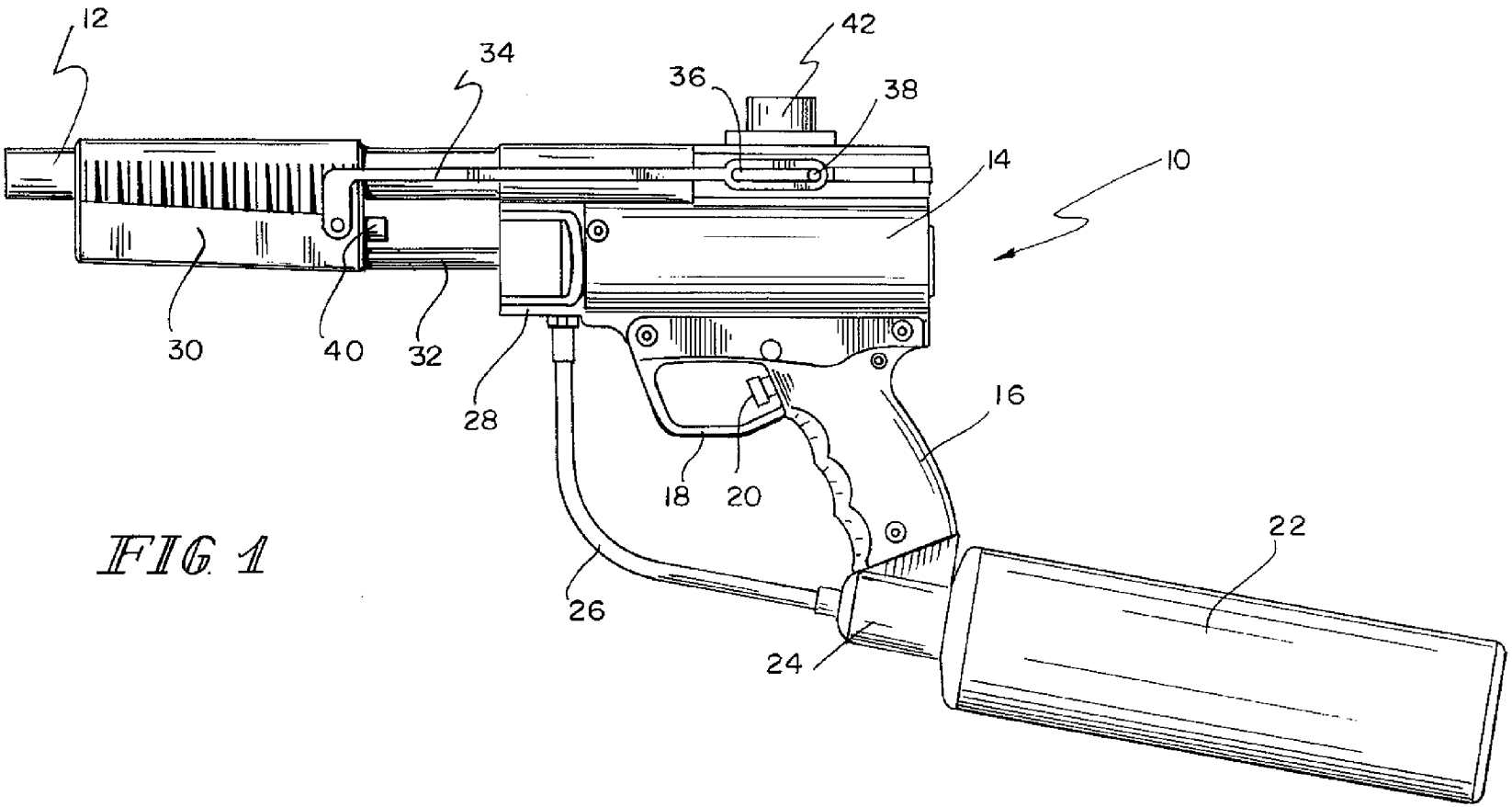
FIG. 1 shows a left side view of one embodiment of a paintball marker.

FIG. 1 shows a left side view of one embodiment of a paintball marker 10. Marker 10 includes a barrel 12 which is secured by threads, as shown in more detail in FIGS. 3-7, to a main body or receiver 14. Attached to the bottom portion of receiver 14 is a grip 16 which includes a trigger guard 18 and a "trigger" 20 which, in the present embodiment, takes the form of a momentary push button switch. Marker 10 further includes a tank 22 which serves as a reservoir for a supply of combustible gas (e.g., propane, butane, MAPP, acetylene, etc.). Tank 22 is coupled to marker 10 by a tank adaptor in the form of regulator 24. One end of a conduit 26, which serves to conduct gas away from tank 22, is coupled to an opposite side of regulator 24. The other end of conduit 26 is connected to a valve body 28 which, in turn, is coupled to receiver 14.

Marker 10 further includes a forestock 30 which surrounds a portion of barrel 12 and which is configured to slide along barrel 12, as discussed more fully below. A rod 32 is connected to one end of forestock 30. The other end of rod 32 extends into valve body 28. One end of a connecting link 34 is also coupled to forestock 30. The other end of link 34 is formed to include a slot 36 which surrounds a pin 38 which is connected to a sliding bolt 100 (see FIGS. 3-7) located within receiver 14. A button 40 is also coupled to forestock 30. Button 40 actuates a valve within valve body 28 when marker 10 is cocked by sliding forestock 30 toward receiver 14, as is further illustrated in FIG. 4.

Figure 2:
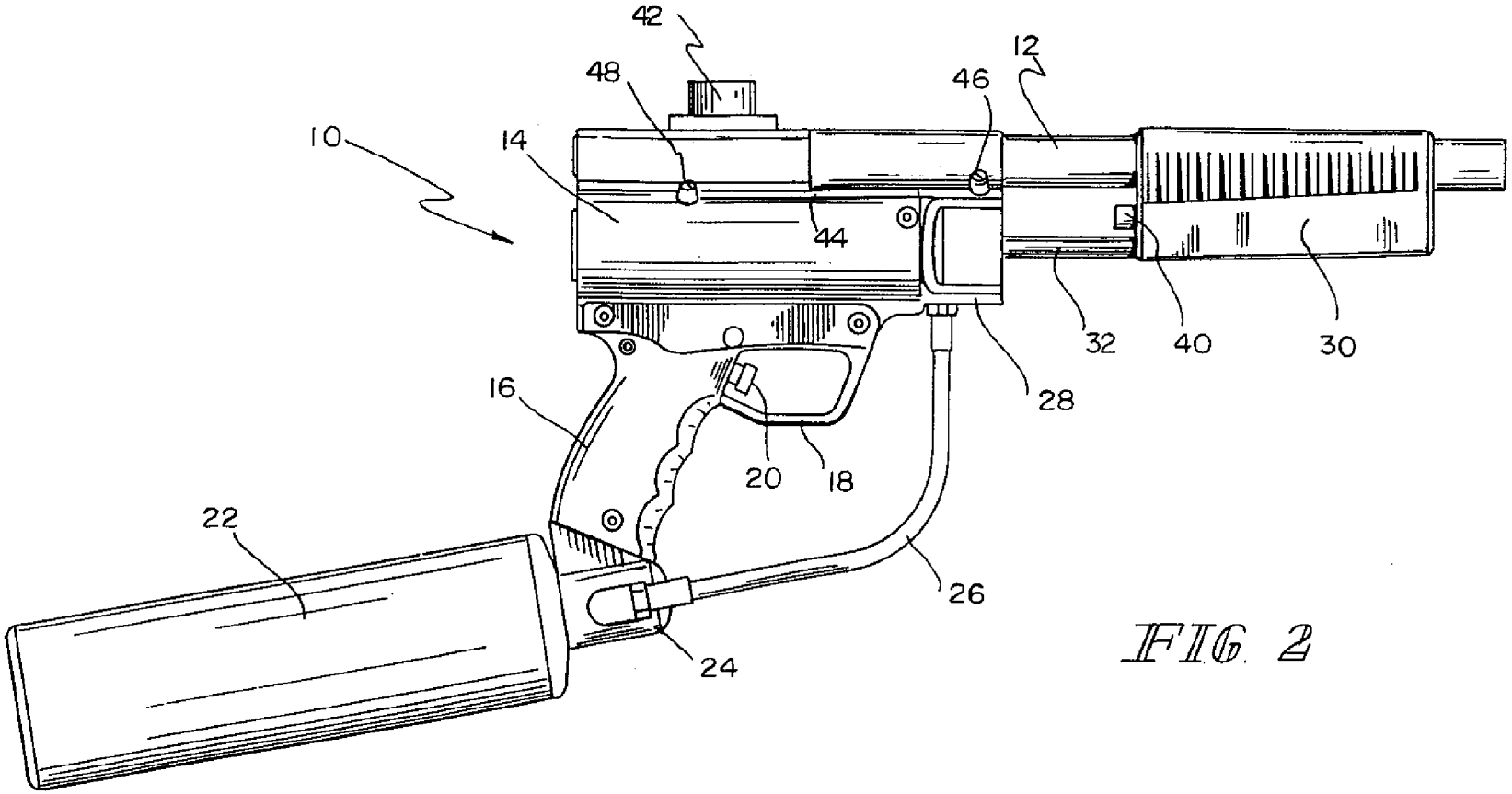
FIG. 2 shows a right side view of the embodiment of FIG. 1.

Also visible in FIGS. 1 and 2 is a ball feeder 42. Feeder 42 is configured to receive a magazine, or other device of known construction, so as to provide a supply of projectiles (e.g., paintballs) to marker 10.

FIG. 2 shows a right side view of the embodiment of FIG. 1. In addition to many of the same components visible in FIG. 1, visible in FIG. 2 is an external gas line 44. A first end 46 of gas line 44 is connected to an opening in valve body 28. The second end 48 of gas line 44 is coupled to a port (106 in FIG. 9) an opening which extends into receiver 14.

Figure 3:
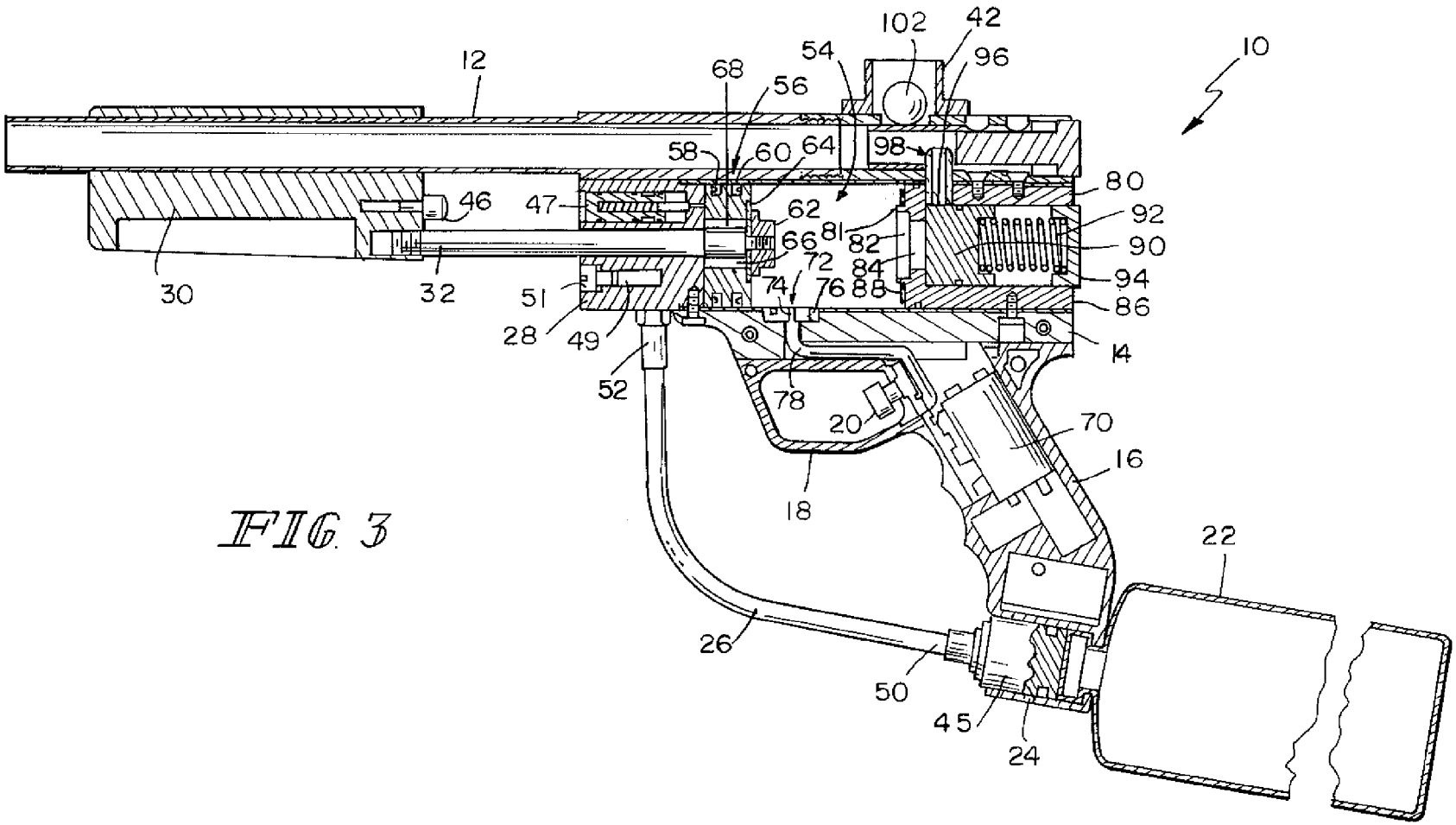
FIG. 3 is a cross-sectional view of the embodiment of FIG. 1 with the components in an "uncocked" or idle position.

FIG. 3 is a cross-sectional view of the embodiment of FIG. 1 with the components in an "uncocked" or idle position. Some additional internal components are visible in FIG. 3. These include regulator 45 which is positioned within tank adaptor 24 and coupled to tank 22. The purpose of regulator 45 is to regulate (i.e., limit the pressure and/or volume of) gas from tank 22. The upstream end 50 of conduit 26 is also coupled to regulator 45.

Also visible in FIG. 3 are the internal components of valve body 28. These include sliding spool valve 47, reservoir 49 and reservoir volume adjusting screw 51. Not shown are the internal passages in valve body 28. These extend from a port to which downstream end 52 of conduit 26 is connected to spool valve 47, from spool valve 47 to reservoir 49, from reservoir 49 to valve 47, and from valve 47 to the opening in valve body 28 which receives first end 46 of external gas line 44. Also formed in valve body 28 are exhaust gas ports, one of which is shown and identified by reference numeral 53 in the front-left side perspective view of FIG. 8.

Also shown in the cross-section of FIG. 3 is a combustion chamber 54. On the left side (as viewed in FIG. 3) of combustion chamber 54 is a piston assembly 56 which is fitted with back-to-back seals 58, 60. Piston 56 is mounted to rod 32, and is configured to move laterally across combustion chamber 54 when rod 32 is so moved. Seal assembly 58, 60 provides a seal between the outer peripheral edge of piston 56 and the walls of combustion chamber 54. Also attached to rod 32 is a member 62 which has a smaller diameter than piston 56. An o-ring seal 64 is provided between a surface of member 62 and piston 56. When rod 32 and piston 56 are moved from the position shown in FIG. 3 toward the position shown in FIG. 4, member 62 separates from piston 56 to allow gases in combustion chamber 54 to move past o-ring 64 and through passages 66 and 68 which extend through piston 56. When rod 32 and piston 56 are moved from the position shown in FIG. 4 toward the position shown in FIG. 3, o-ring seal 64 and member 62 seal passages 66 and 68, preventing gases from flowing therethrough.

Also shown in FIG. 3 are the components of an ignition system. These components include battery 70, "trigger" 20, and spark generator assembly 72. In the present embodiment, spark generator 72 comprises a metal conductor 74, which extends into combustion chamber 54, and is insulated from the sidewalls of combustion chamber 54 by an insulating member 76. A spark gap is formed between the exposed end of conductor 74 and the sidewall of combustion chamber 54. With the exception of this gap, the portions of spark assembly 72 which open into combustion chamber 54 are shaped to conform to the adjacent sidewalls of combustion chamber 54, and to allow piston 56 and seals 58, 60 to pass with a minimal amount of gas leakage. In the embodiment shown, metal conductor 74 is formed from the exposed end of an insulated wire 78. The other end of wire 78 is connected through a sparking circuit to one side of the momentary push button switch which forms "trigger" 20. The other side of the momentary switch is connected, via an insulated conductor, to the positive side of battery 70. The negative side of battery 70 is connected to the frame of the marker, and specifically to that portion of the sidewall of combustion chamber 54 which surrounds spark assembly 72.

Figure 4:
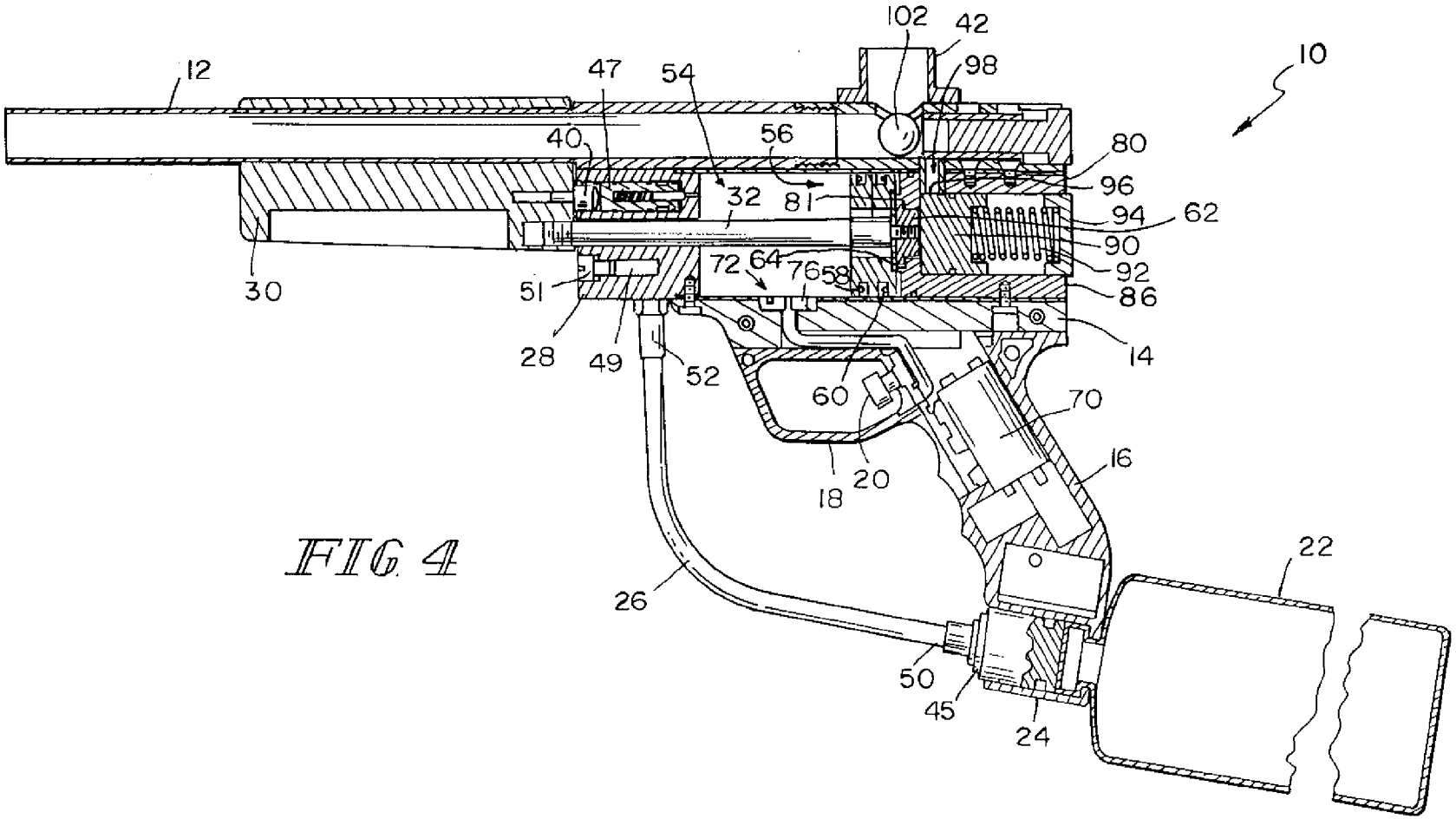
FIG. 4 is a cross-sectional view of the embodiment of FIG. 1 with the components shown in the course of a "cocking" operation.

Also shown in FIG. 3 is a rear member 80, a left-most peripheral portion of which forms part of the sidewall of combustion chamber 54. Formed in this left-most portion is a through bore 82 and a counter sink 84. Bore 82 and counter sink 84 are shaped so as to receive member 62, as illustrated in FIG. 4. This feature allows piston 56 to travel substantially entirely through combustion chamber 54 to abut (or come close to abutting) left-most portion 81. Not shown in FIG. 3 are a plurality of bores which extend through member 80. Ends of these bores open on peripheral surface 86 of member 80. The other ends open behind an annular rubber valve member 88 which extends around a portion of left-most peripheral portion 81. Ends of these bores which open on peripheral surface 86 are visible in the rear-right perspective view of FIG. 9. One such bore begins under rubber valve member 88 in left-most portion 81, but does not extend all the way through element 80. Rather, that bore extends only partially through element 80, and then extends laterally through receiver 14 and is coupled to end 48 of external gas line 44. This opening is also visible in FIG. 9.

Positioned within a bore formed in element 80 is another piston 90 which, in the illustrated embodiment, is smaller in diameter than piston 56. Piston 90 is biased toward the position shown in FIG. 3 by spring 92. Spring 92 may be compressed, and the biasing force thus adjusted, by means of threaded plug 94. A peripheral portion 96 of piston 90 seals an opening 98 which extends through element 80, receiver 14 and bolt 100. As illustrated in FIG. 3, bolt 100 prevents a paintball 102 from descending into a firing position when the marker is in the idle position depicted in FIG. 3.

The operation of the illustrative embodiment will now be described by reference to FIGS. 3-7. Marker 10 is shown in the idle or uncocked state in FIG. 3. In this state, paintball 102 is prevented from falling into the chamber formed at the junction of barrel 12 and receiver 14. Combustion chamber 54 is either empty (i.e., filled with atmospheric gases) or with exhaust gases left over from a preceding shot. Spool valve 47 is positioned (by virtue of spring biasing) as shown in FIG. 3 in its left-most position. This position stops the flow of combustible gas through conduit 26. Forestock 30, along with rod 32 and button 40 are in their left-most positions.

In FIG. 4, forestock 30 has been moved to the right. Button 40 has contacted and shifted spool valve 47 to the right, and rod 32 has caused piston 56 to traverse combustion chamber 54, as illustrated. The rightward shifting of spool valve 47 allows combustible gas to flow through conduit 26 and valve 47 to reservoir 49. As piston 56 traverses combustion chamber 54, the contents of chamber 54 (i.e., atmospheric or exhaust gases) are allowed to flow through bores 66 and 68 by virtue of the "opening" of the seal formed by o-ring 64 and element 62. Thus, these gases are disposed on the left or backside of piston 56 when piston 56 is positioned as shown in FIG. 4. Also, as forestock 30 moves to the right, link 34 causes bolt 100 to slide to the right, allowing paintball 102 to drop into alignment with barrel 12.

Figure 5:
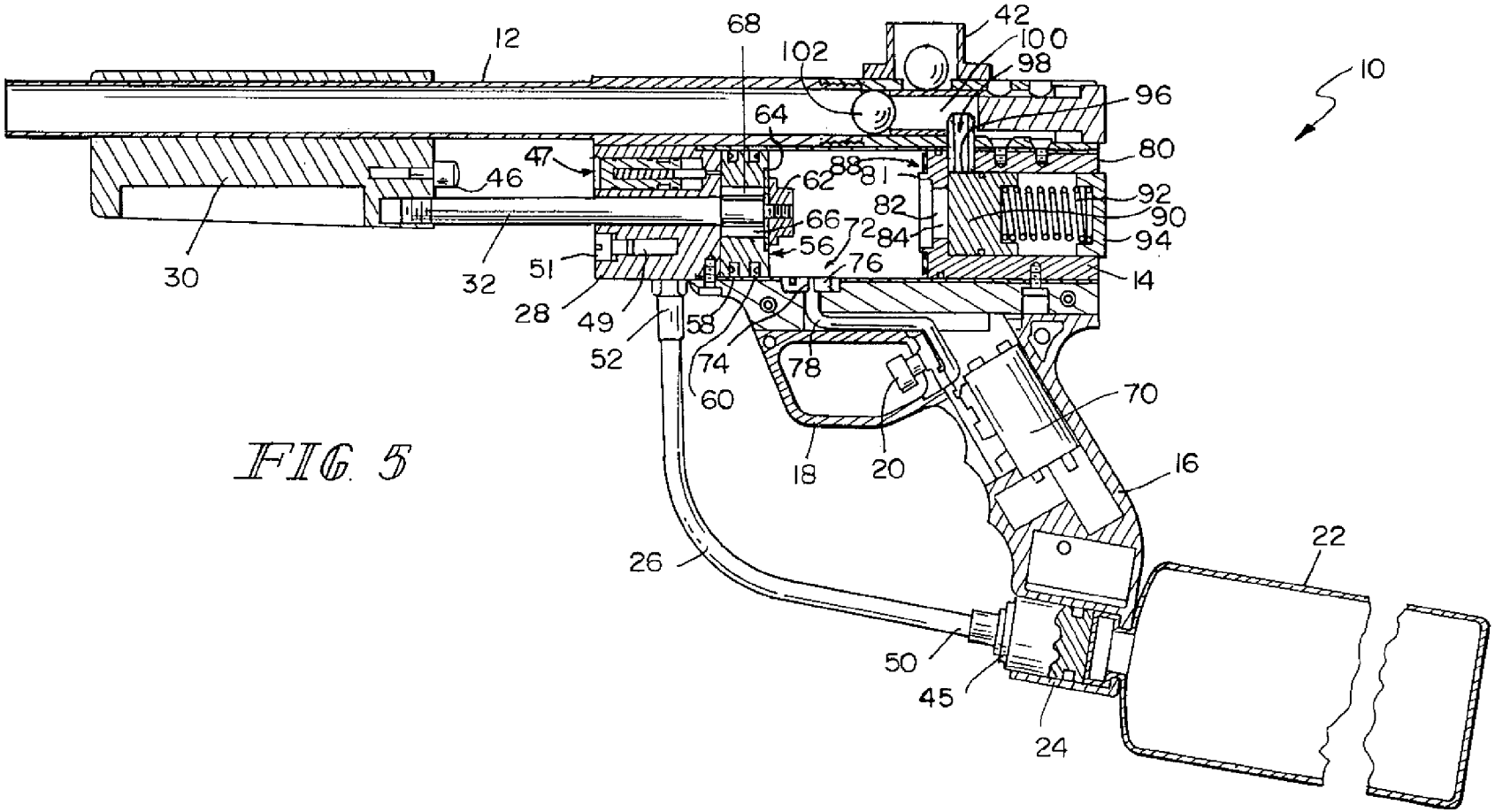
FIG. 5 is a cross-sectional view of the embodiment of FIG. 1 with the components in the "cocked" or ready-to-fire position.

FIG. 5 shows marker 10 after forestock 30 and its connected structures are moved back to the position of FIG. 3. This movement causes several things to happen. First, the leftward shifting of spool valve 47 causes the gas which was previously allowed to flow into reservoir 49 to be made available to first end 46 of gas line 44. Second, as piston 56 moves from right to left within combustion chamber 54, the contents of chamber 54 are pushed by piston 56 through the exhaust bores (for example, bore 53 in FIG. 8) formed in valve body 28. At the same time, the action of piston 56 draws fresh air into combustion chamber 54 through the bores formed in element 80. It should be noted that these bores are sealed by the action of rubber element 88 when piston 56 moves from left to right through combustion chamber 54. However, when piston 56 moves from right to left, rubber element 88 allows fresh air to flow through the bores and into the interior of combustion chamber 54. As previously noted, one of the bores which extends through a portion of element 80 is coupled to second end 48 of gas line 44. Thus, as piston 56 draws in fresh air through the other bores, the combustible gas from reservoir 48 is also drawn into combustion chamber 54 through this bore and external gas line 44. Thus, a mixture of combustible gas and fresh air are provided in combustion chamber 54. In addition to these changes, paintball 102 is pushed forward by bolt 100, by the action of link 34 and pin 38, as forestock 30 reaches its left-most position. Marker 10 is now ready to fire.

In order to fire marker 10, the momentary switch which forms "trigger" 20 is depressed to connect spark assembly 72 to battery 70. It should be noted that, although in the illustrated embodiment trigger 20 is formed as the button of a switch, a trigger of more conventional design could be employed. Unconventional triggers and/or alternative mechanisms for generating a spark, (using, for instance, one or more capacitors, a coil, magneto, or other spark generating mechanism) can also be used to generate the firing spark. It should be noted that, in the embodiments illustrated, spark assembly 72 is positioned in a sidewall of combustion chamber 54 at a point which is generally opposite and relatively distant from bore 82 and opening 98. It has been found that by so positioning the igniter, more satisfactory pressures are generated by the explosion of the combustible gas/air mixture.

Figure 6:
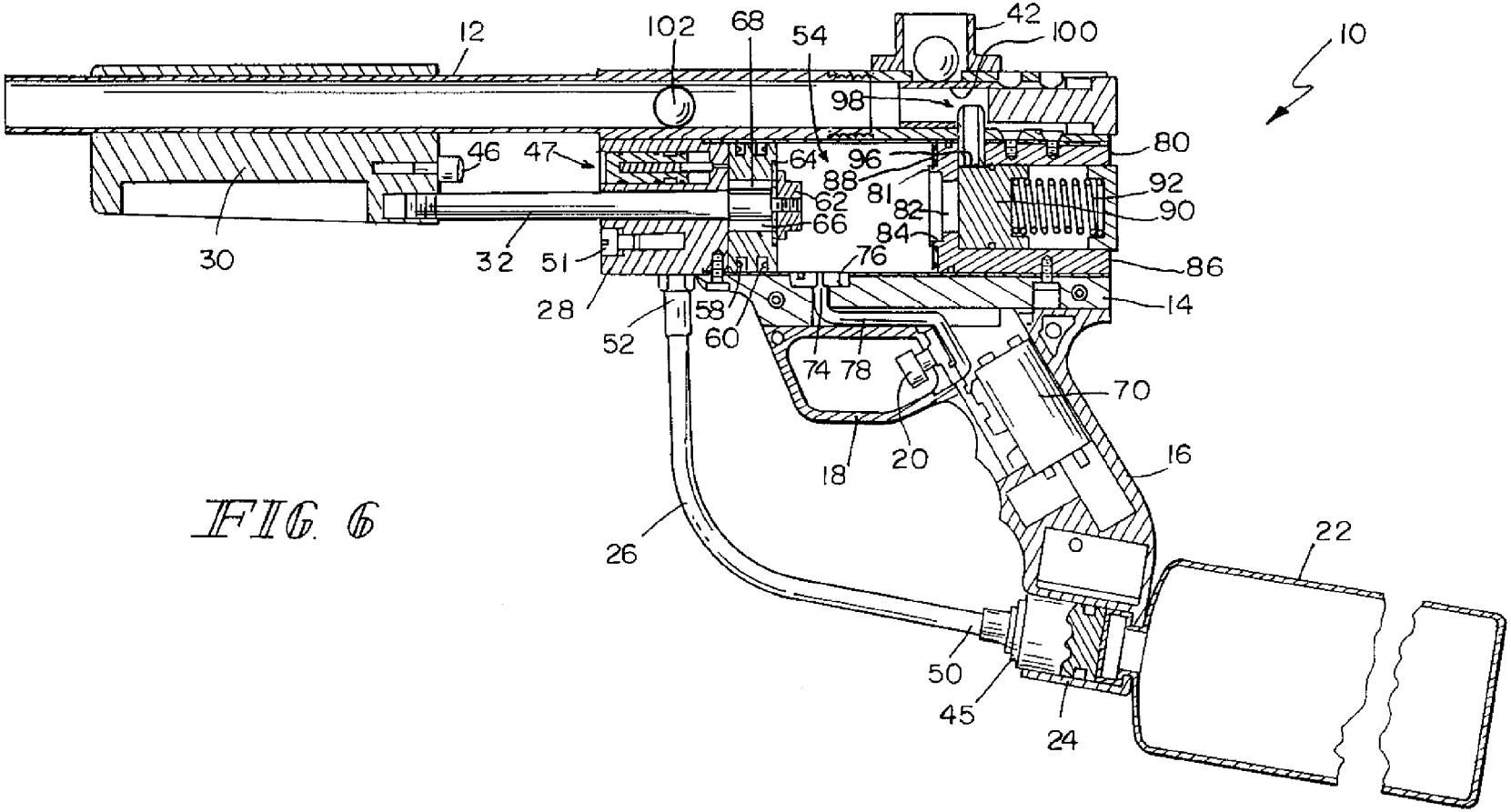
FIG. 6 is a cross-sectional view of the embodiment of FIG. 1 showing the internal components immediately after firing.

FIG. 6 is a cross-sectional view of the embodiment of FIG. 1 showing the internal components immediately after firing.

As shown in FIG. 6, the spark has produced an explosion and consequent increase in pressure inside combustion chamber 54. Chamber 54 is sealed on the left by member 62 and o-ring 64, and on the right by rubber element 88. However, the increased pressure and explosion gases generated act on piston 90 via bore 82. As shown in FIG. 6, piston 90 is shifted to the right, and the explosion gases flow through opening 98 to propel paintball 102 through barrel 12. It should be noted that, in the illustrated embodiment, piston 90 offers initial resistance to the increase in pressure by virtue of the compression force generated by spring 92. This allows the pressure to build to a predetermined level before piston 90 shifts. This predetermined pressure level may be adjusted by adjusting the biasing force of spring 92, via threaded plug 94. This feature is particularly useful in the illustrated embodiment of the invention, due to the relatively loose fit existing between paintball 102 and barrel 12. A tight fitting projectile may offer sufficient resistance to allow combustion pressure to build to the desired level without need for spring biased piston 90, or comparable mechanisms. However, for frangible projectiles such as paintballs, a loose fit between ball and barrel is typical.

It is also noted that the overall diameter of piston 90 is larger than the diameter of bore 82. Thus, pressure in the combustion chamber acts initially only on a portion of the area of the "face" of piston 90. However, after piston 90 is shifted to the right, pressure from the combustion chamber acts against the entire face (i.e., a larger area). This means that the piston will open at a relatively higher pressure than is required to maintain the piston in the open position. This feature also assures that piston 90 will "jump" open when the pressure inside the combustion chamber reaches the desired level, and will not flutter or hesitate.

As illustrated in FIGS. 3-7, opening 98 extends substantially perpendicularly to a longitudinal centerline of barrel 12, and extends through element 80, receiver 14 and bolt 100 at a point which is relatively close to the point at which a projectile, such as paintball 102, enters the receiver and is positioned for firing in alignment with the barrel (see, in particular, FIG. 5). This arrangement substantially reduces the length of the flow path through which pressurized gases from combustion chamber 54 must flow prior to propelling a projectile through barrel 12. This arrangement is further facilitated by the positioning of combustion chamber 54 adjacent the longitudinal centerline of barrel 12 and generally adjacent the area in which the projectile enters the receiver and is positioned by bolt 100 for firing. This arrangement also shortens the overall length of a paintball marker in comparison to, for example, an arrangement wherein the combustion chamber is positioned coaxially with a barrel.

Figure 7:
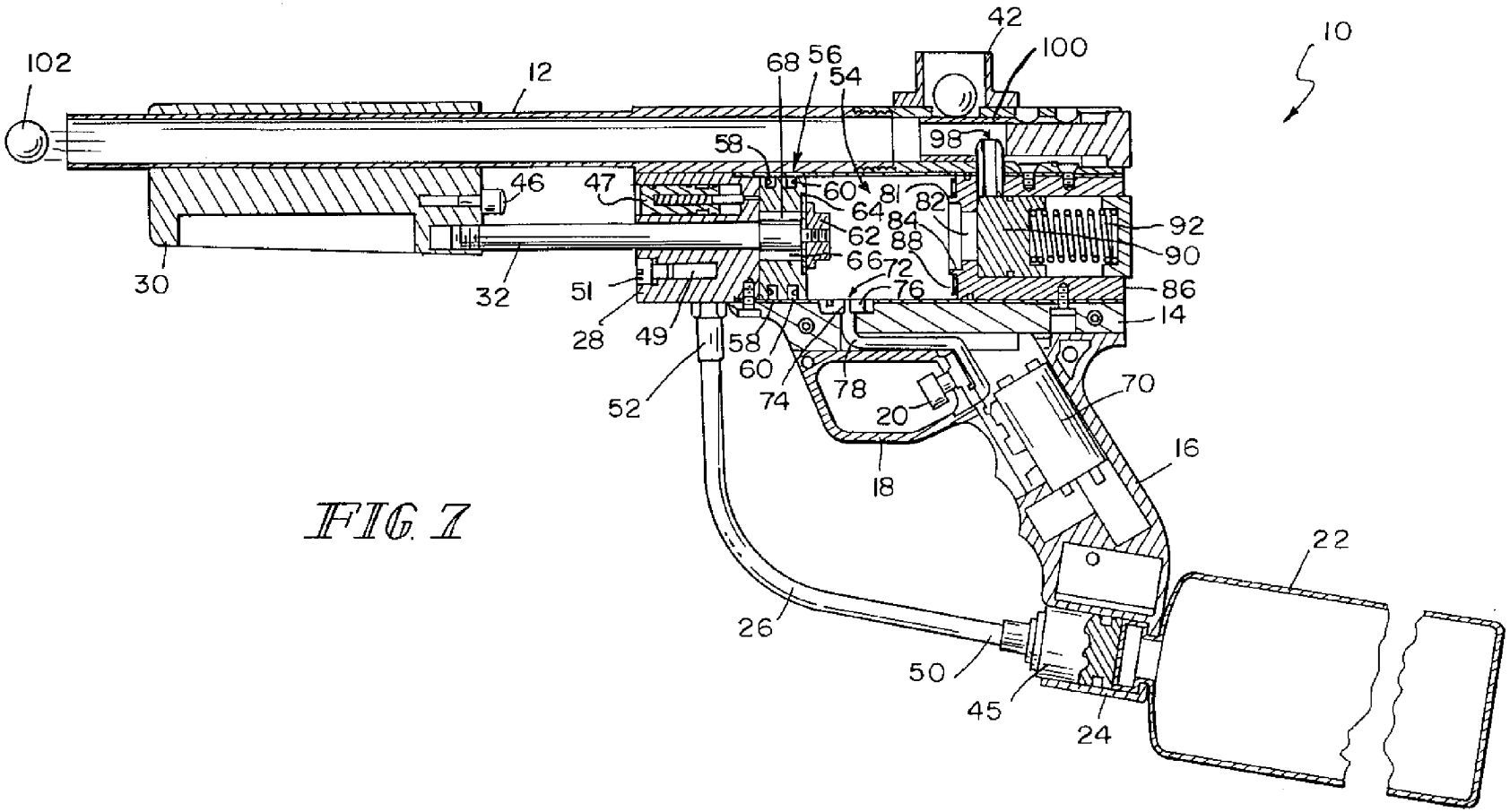
FIG. 7 is a cross-sectional view of the embodiment of FIG. 1 showing the internal components returned to the idle or uncocked position as the projectile exits the apparatus.

FIG. 7 is a cross-sectional view of the embodiment of FIG. 1 showing the internal components returned to the idle or uncocked position as the projectile exits marker 10. As illustrated, piston 90 has returned to its left-most position. Combustion chamber 54 is now filled with exhaust gases. With the exception of ball 102 shown exiting barrel 12, the components of marker 10 illustrated in FIG. 7 have returned to the uncocked or idle position shown in FIG. 3.

Figure 8:
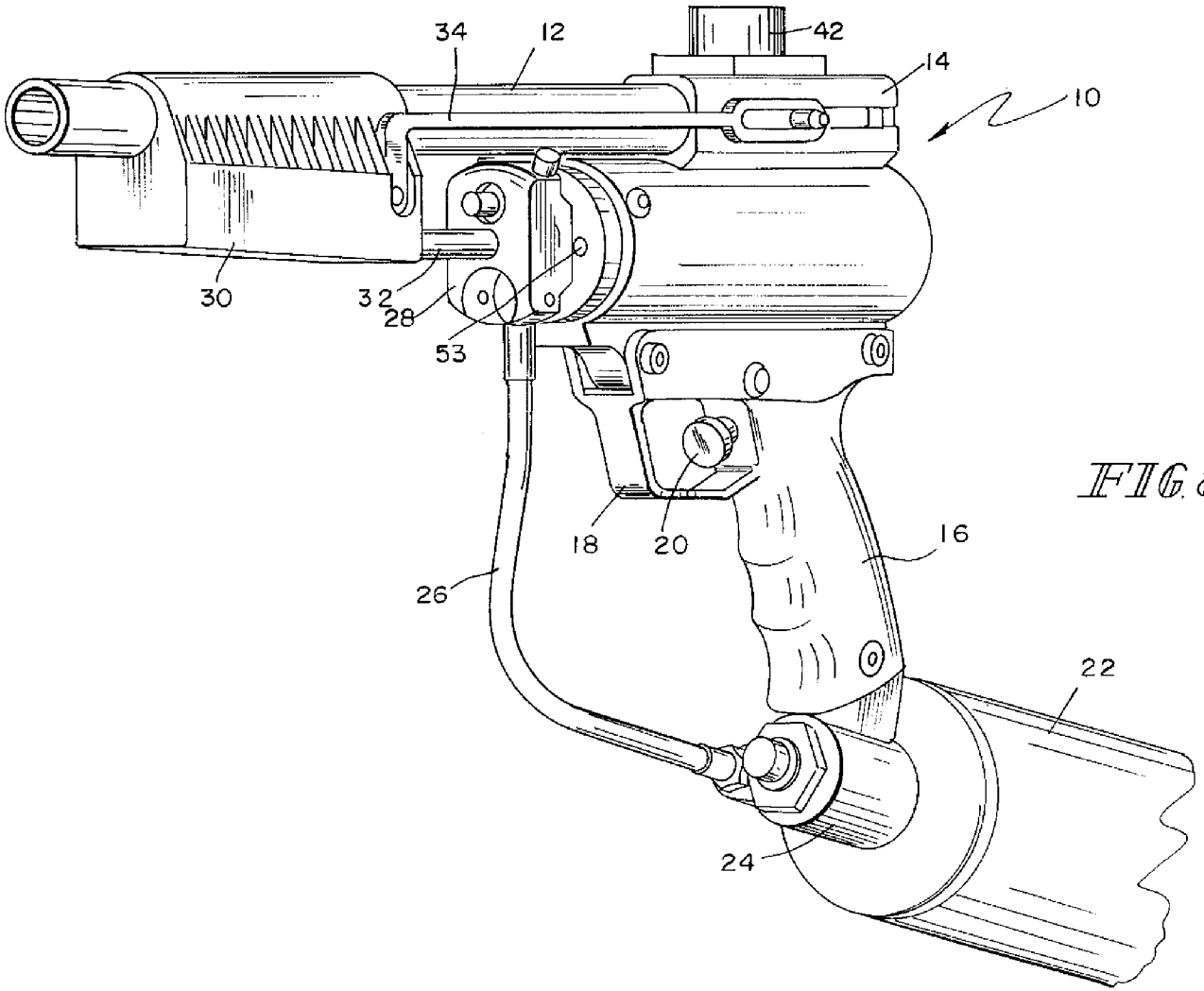
FIG. 8 shows a partial front left side perspective view of one embodiment of a paintball marker.

FIG. 8 shows a partial front left side perspective view of one embodiment of a paintball marker. As previously noted, FIG. 8 shows exhaust gas port 53, which is one of a pair of such ports in the illustrated embodiment.

Figure 9:
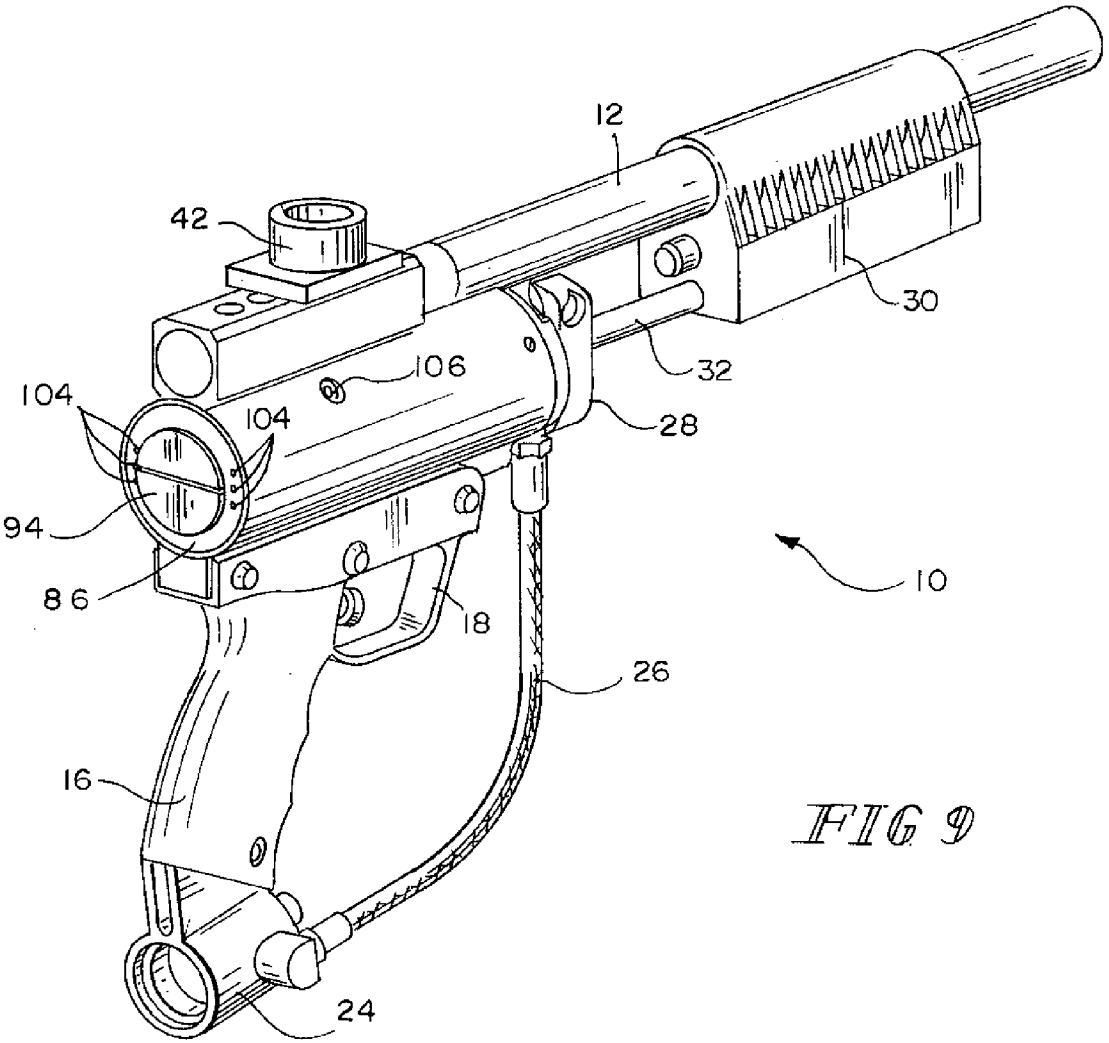
FIG. 9 shows a partial rear right side perspective view of one embodiment of a paintball marker.

FIG. 9 shows a partial rear right side perspective view of one embodiment of a paintball marker. As previously noted, visible in FIG. 9 are fresh air ports 104 which extend through rear member 80 and open onto surface 86 to provide fresh combustion air to combustion chamber 54 as previously described. Also shown in FIG. 9 is port 106 which receives second end 48 of gas line 44 (not shown).

Figure 10:
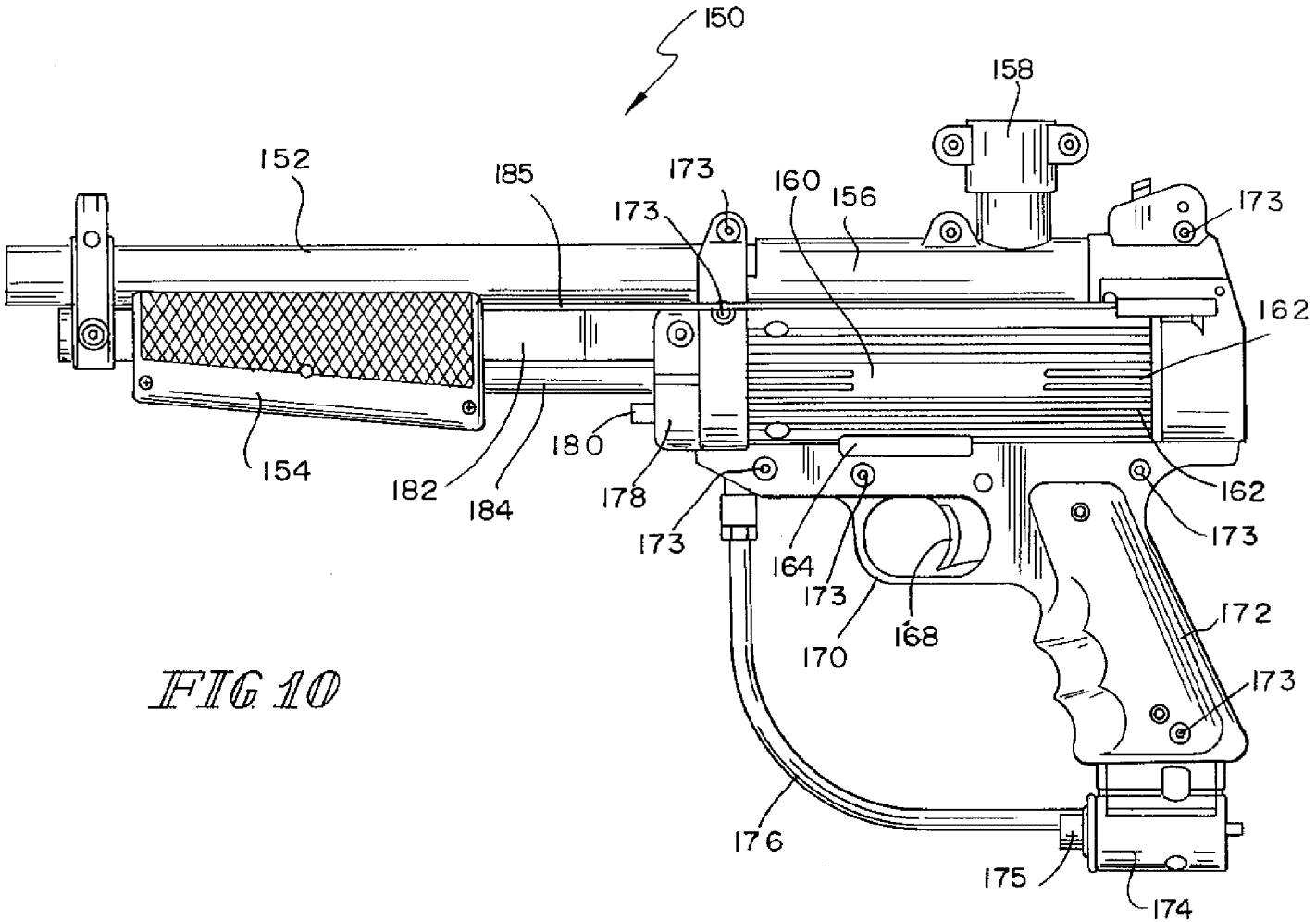
FIG. 10 is a side view of another embodiment of a paintball marker.

FIG. 10 shows a side view of another embodiment of a paintball marker 150, which includes various components similar to marker 10. Marker 150 includes barrel 152 which is formed of a non-metallic material, such as fiberglass, for example. The use of non-metallic material inhibits the formation of condensation on the interior surface of barrel 152. Marker 150 also includes forestock 154, which functions similarly to forestock 30 as described above. Ball feeder 158 is disposed on receiver 156 of marker 150.

Figure 11:
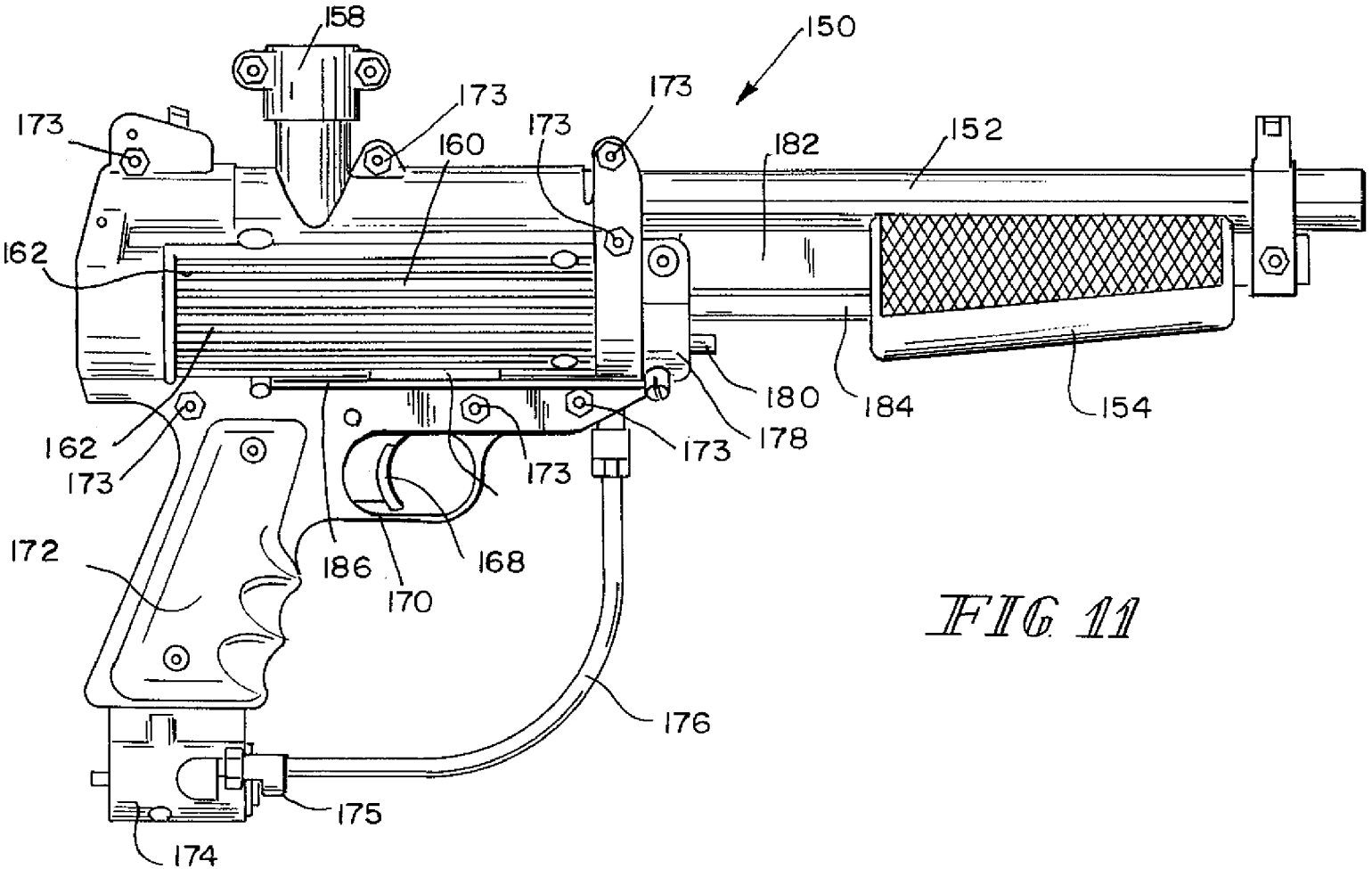
FIG. 11 is another side view of the embodiment of the paintball marker shown in FIG. 10.

Combustion chamber 160 is disposed within receiver 156. Chamber 160 is cylindrically shaped with a plurality of cooling fins 162 formed longitudinally thereon. Clips 164, 166 each extend outwardly from a respective side of receiver 156 and engage combustion chamber 160 to brace receiver 156 during combustion. Clip 166 is shown in FIG. 11. As in the embodiment illustrated in FIG. 1-9, combustion chamber 160 is positioned substantially adjacent a longitudinal centerline of barrel 152. This arrangement is preferred for the reasons discussed above in connection with the other embodiment.

Marker 150 includes trigger 168 and trigger guard 170. Trigger guard 170 is coupled to both receiver 156 and grip 172. Grip 172 is integrally formed with receiver 156. The grip/receiver configuration can be separated into "halves" which are fastened together through fasteners 173. This configuration is disclosed in U.S. patent application Ser. No. 11/047,931, which is incorporated by reference herein.

Figure 13:
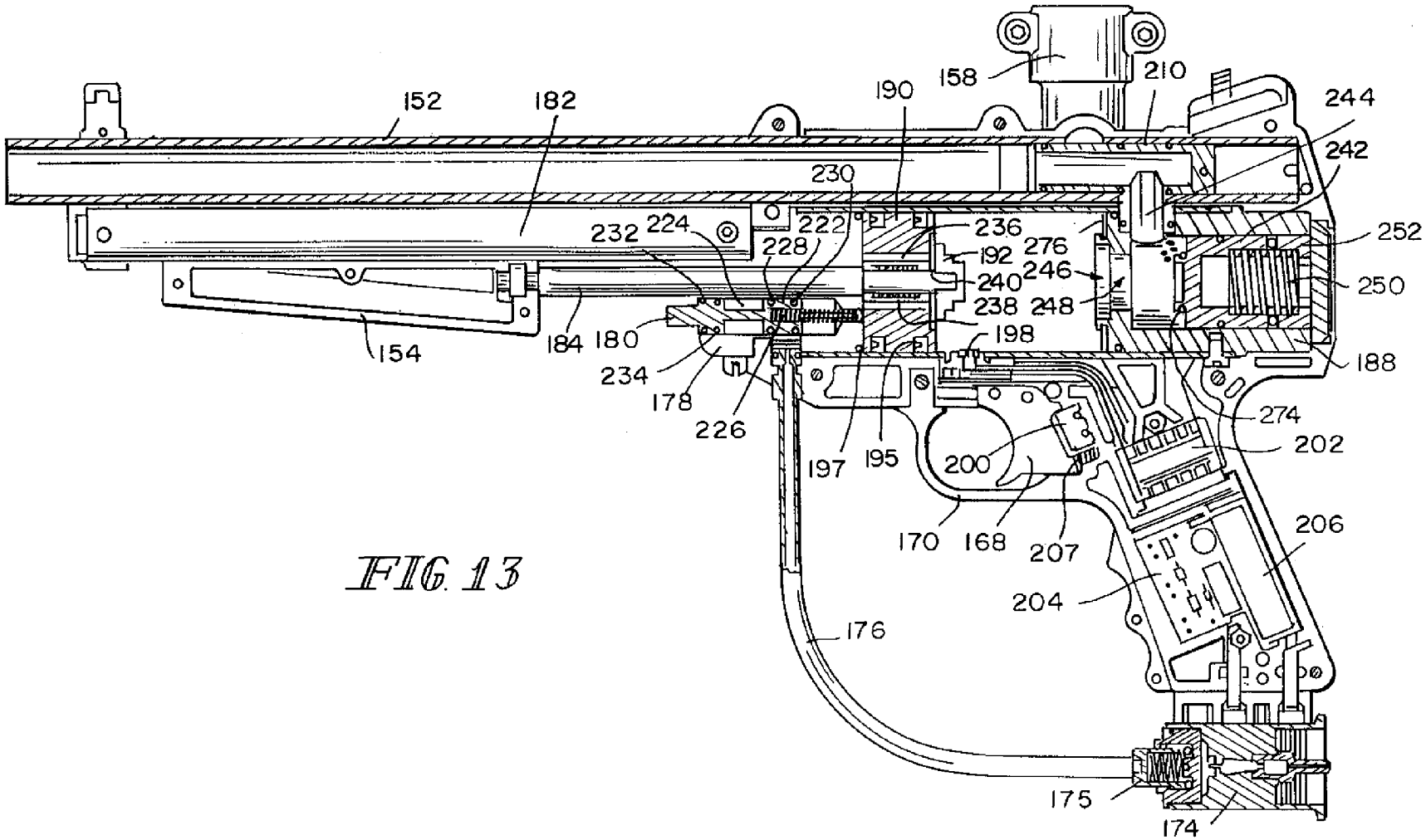
FIG. 13 is a cross-sectional side view of the embodiment shown in FIG. 10.

A tank adaptor in the form of regulator 174 is coupled to the bottom of grip 172 with one end of regulator 174 configured to receive a container of combustible gas (not shown). The opposite end of regulator 174 is coupled to conduit 176, which conducts combustible gas from a container to valve 178. Button 180 extends outwardly from valve 178. Forestock 154 is actuable along rod 182. Forestock 154 engages button 180 when cocked for firing, which allows gas to enter valve 178 and subsequently be drawn or injected into combustion chamber 160. An adjustment screw 175 is provided to control the pressure/volume of gas provided to valve 178. Rod 184 is coupled to forestock 154 and partially extends into combustion chamber 160 when forestock 154 is actuated towards button 180 as shown in FIG. 13.

Figure 12:
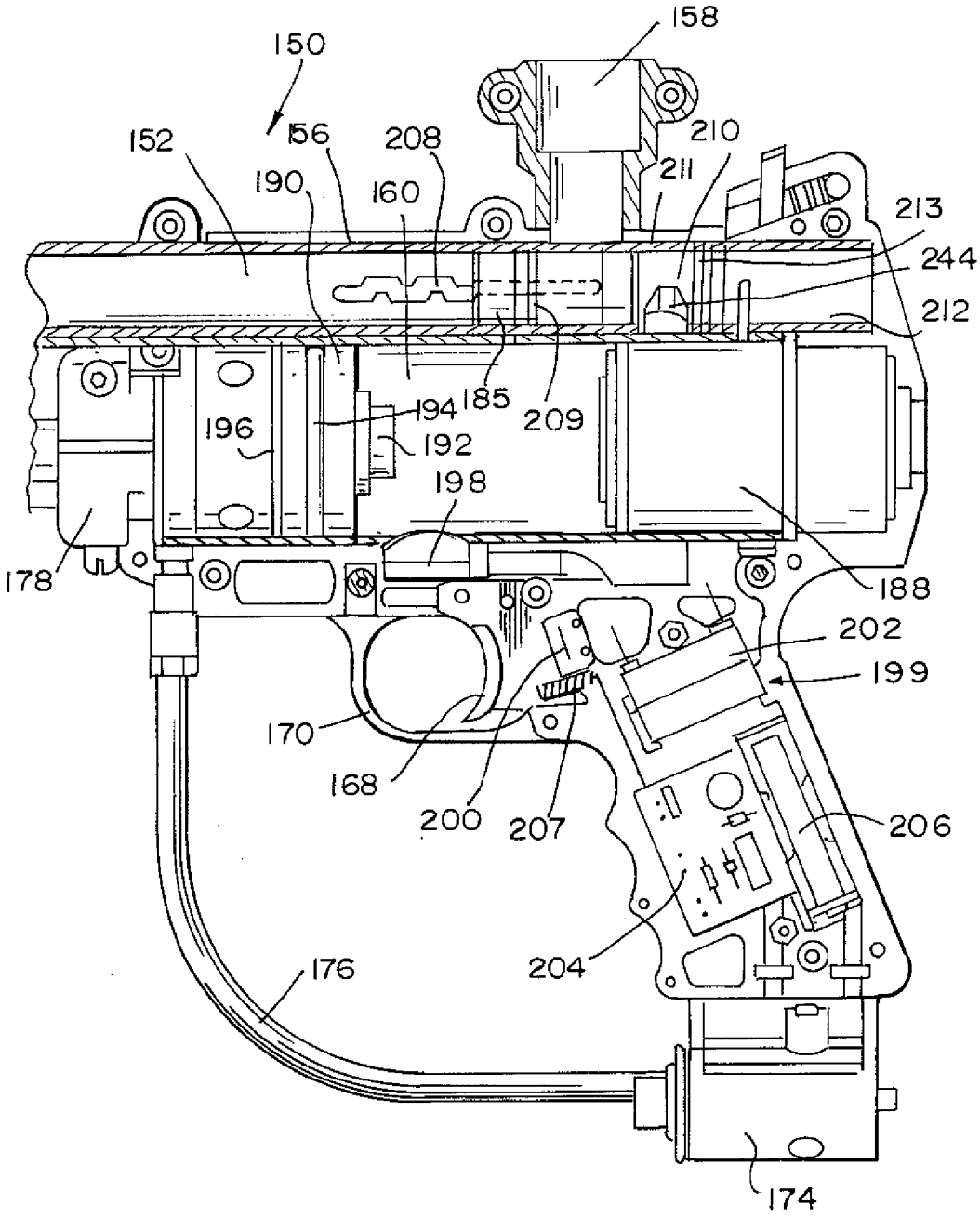
FIG. 12 is an internal side view of the embodiment shown in FIG. 10.

Rod 185 is connected to forestock 154 and is actuated towards combustion chamber 160 when forestock 154 is cocked for firing. As shown in FIG. 12, rod 185 is connected to bolt 210, which in this embodiment is disposed in barrel 152. Actuation of rod 185 actuates bolt 210 allowing a paintball to drop through ball feeder 158 into barrel 152. When rod 185 is actuated in the opposite direction, bolt 210 pushes the paintball forward into position for firing.

FIG. 11 is another side view of marker 150. This view shows clip 166, which engages cooling fin(s) 162 of combustion chamber 160 for bracing. FIG. 11 also shows external gas line 186 extending from valve 178 to combustion chamber 160. External gas line 186 terminates at a bore located within combustion chamber 160, which allows combustible gas in line 186 to be introduced into combustion chamber 160 for combustion.

FIG. 12 shows an internal side view of a portion of marker 150. Rear member 188 is disposed within combustion chamber 160. Similar to marker 10, marker 150 includes a piston 190 and member 192, which travel from right to left when forestock 154 is cocked for firing. Seal 194 provides a seal between the outer peripheral edge of piston 190 and the walls of combustion chamber 160. The shape of piston 190 conforms to the interior of combustion chamber 160. In this embodiment and that of marker 10, the shape of piston 190 allows substantially all of the exhaust gases from combustion chamber 160 to be expelled from combustion chamber 160 when piston 190 moves from right to left in FIG. 12. Seal 196 seals the combustion chamber from valve 178.

Igniter 198 is disposed between receiver 156 and combustion chamber 160 and extends through an opening in the sidewall of combustion chamber 160. Igniter 198 is shaped to conform to the inside of combustion chamber 160 and is positioned to allow piston 190 to move through combustion chamber 160 and to ensure substantially all of the exhaust gases are swept out of combustion chamber 160. Clips 164, 166, shown in FIGS. 10 and 11, brace the adjacent portion of the receiver in the vicinity of igniter 198 so that it is not forced out of combustion chamber 160 during combustion and to prevent or reduce flexing of the receiver in this area. Igniter 198 is connected to igniter circuit 199, which includes switch 200, induction coil 202, circuit board 204, and battery 206. These components are sealed within grip 172 and are responsible for producing a spark through igniter 198 to initiate combustion in combustion chamber 160. When trigger 168 is actuated it closes switch 200, which activates the other components in igniter circuit 199 to produce a spark. In certain embodiments, a series (e.g., three) sparks are produced in rapid succession when the trigger is pulled. The trigger must then be released and pulled again to fire another shot. Spring 207 biases trigger 168 back into the position shown in FIG. 12 after it is released.

FIG. 12 also shows ball latch 208. In this embodiment, ball latch 208 consists of an element formed to keep a paintball in barrel 152 prior to firing. In operation, forestock 154 is cocked for firing, which actuates rod 185 toward combustion chamber 160. Rod 185 extends through slot 212 and is connected to bolt 210. This actuation displaces bolt 210 allowing ball feeder 158 access to the interior of barrel 152 and a paintball is deposited therein. The deposited paintball is prevented from rolling down barrel 152 by ball latch 208. When forestock 154 is returned to the position shown in FIGS. 10 and 11, rod 185 forces bolt 210 forward and moves the paintball forward in barrel 152 for firing. In this position, a downstream end of passageway 244 is aligned with an opening in bolt 210 to allow combustion gases to pass therethrough and into barrel 152 for firing. Seals 209, 211, 213 prevent gases from escaping from around barrel 152 and from ball feeder 158 during the firing of a paintball.

FIG. 13 shows a sectional side view of marker 150. Marker 150 is in a stage similar to that shown in FIG. 6 with marker 10. In FIG. 13, combustion gases have been ignited in combustion chamber 160 to fire a paintball (not shown). This view shows the internal components of valve 178, which include valve spool 222. When forestock 154 is moved to the right, button 180 is pushed toward combustion chamber 160, and spool 222 is displaced to the right of the position shown allowing gases in conduit 176 to flow into reservoir 224. When forestock 154 is moved to the left, spring 226 forces spool 222 back into the position shown in FIG. 13, blocking off conduit 176 from allowing more gas into reservoir 224. Seals 228, 230 prevent further gas flow from conduit 176. Seals 232, 234 prevent gases from escaping reservoir 224 and into the atmosphere. FIG. 13 also shows the internal components of regulator 174. Adjustment screw 175 is used to set the pressure of gas allowed to flow into conduit 176. The configuration shown contains components to regulate the gas pressure, similar to that of regulator 45, and is well known in the art.

Piston 190 is connected to rod 184. Similar to the arrangement described above in connection with marker 10, member 192 separates from piston 190 when forestock 154 is actuated from left to right. This allows exhaust gases in combustion chamber 160 to pass through passages 236, 238 onto the other side of piston 190. These gases are then expelled from combustion chamber 160 when piston 190 moves from right to left. Seal 240 is disposed in member 192 and seals passages 236, 238 when piston 190 and member 192 are moving from right to left. It is noted that, in the embodiment of FIG. 13, a double seal 195 is provided around the periphery of piston 190. These seals prevent exhaust gas from leaving by piston 190 as it moves from right to left. An o-ring seal 197 is also provided to prevent combustion pressure from escaping through seals 195 and by piston 190.

Piston 242 is shown actuated to the left allowing combustion gases access to passageway 244. The gases flow through bore 248 and countersink 246. Spring 250 is compressed during the stage shown. The biasing force of spring 250 is adjusted through threaded plug 252, which affects the combustion pressure necessary to displace piston 242. The force exerted by spring 250 also controls the length of displacement to the right undergone by piston 242 in response to pressure generated in combustion chamber 160. When piston 242 is displaced all the way to the right, as shown in FIG. 13, vent holes 266-272 are uncovered, allowing pressurized gases from combustion chamber 160 to flow directly into the atmosphere. Decreased pressure within combustion chamber 166 will displace piston 242 to a lesser degree, allowing piston 242 to cover and block vent holes 266-272. Incrementally increasing pressures will result in piston 242 uncovering incrementally increasing portions of vent holes 262-272, thus providing a degree of regulation of the pressure produced for expelling a projectile from barrel 152. Adjusting threaded plug 252 to increase or decrease the force required to displace piston 242 provides a degree of velocity adjustment, which is a useful feature, particularly in the context of paintball markers and paintball gaming regulations.

Figure 13A:
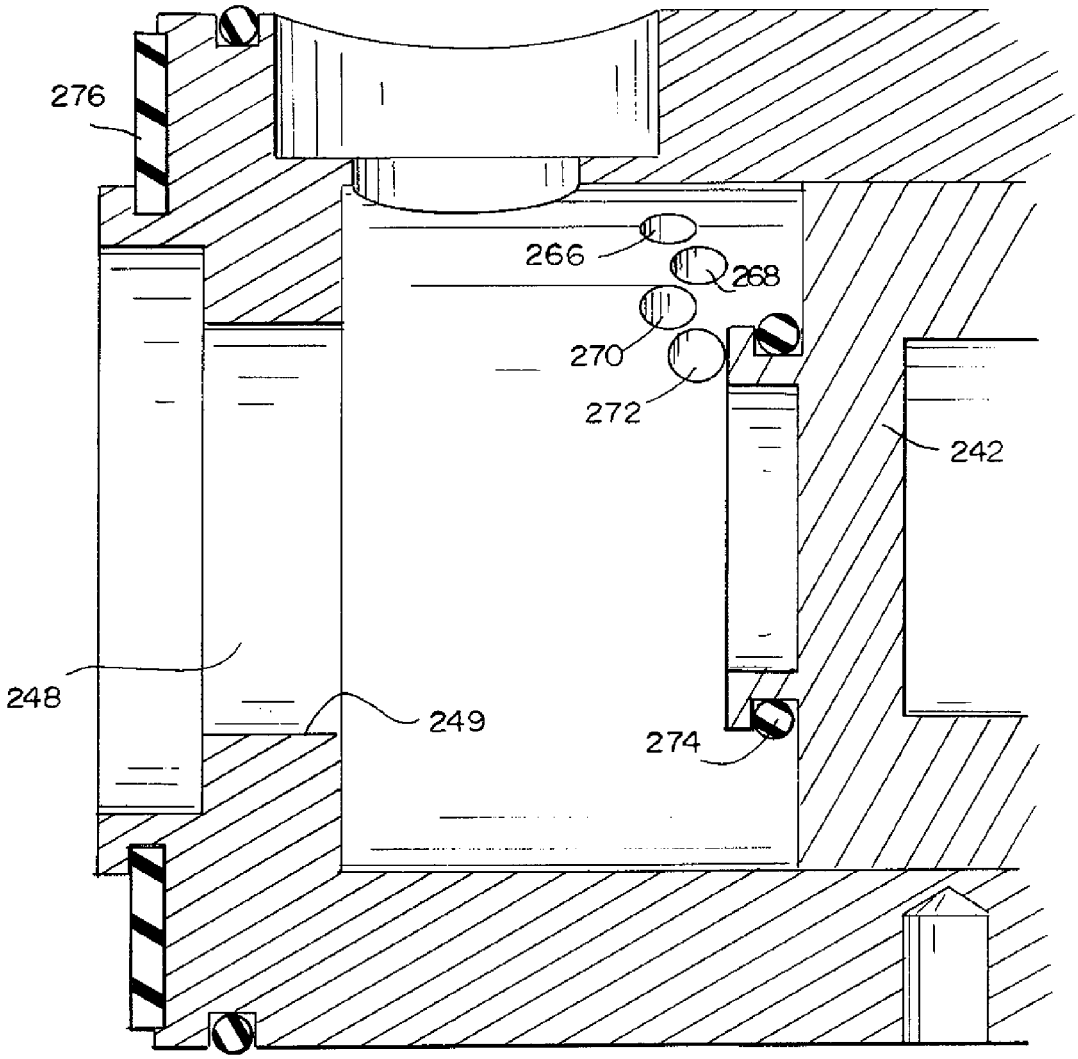
FIG. 13*a* is a close-up of a portion of FIG. 13.

FIG. 13*a* shows a close-up of a portion of FIG. 13, better illustrating the relative positions of vent holes 266-272 and piston 242 when the latter is shifted to the right so as to uncover or open the vent holes. Also shown in FIG. 13*a* is an o-ring seal 274 which provides a seal with surface 249 of bore 248 when piston 242 is "closed" (i.e., displaced all the way to the left as shown in FIGS. 13 and 13*a*). The presence of seal 274 further contributes, in combination with the dimensions of piston 242 and bore 248, to more reliable operation of piston 242 in response to pressure in combustion chamber 160.

Figure 14:
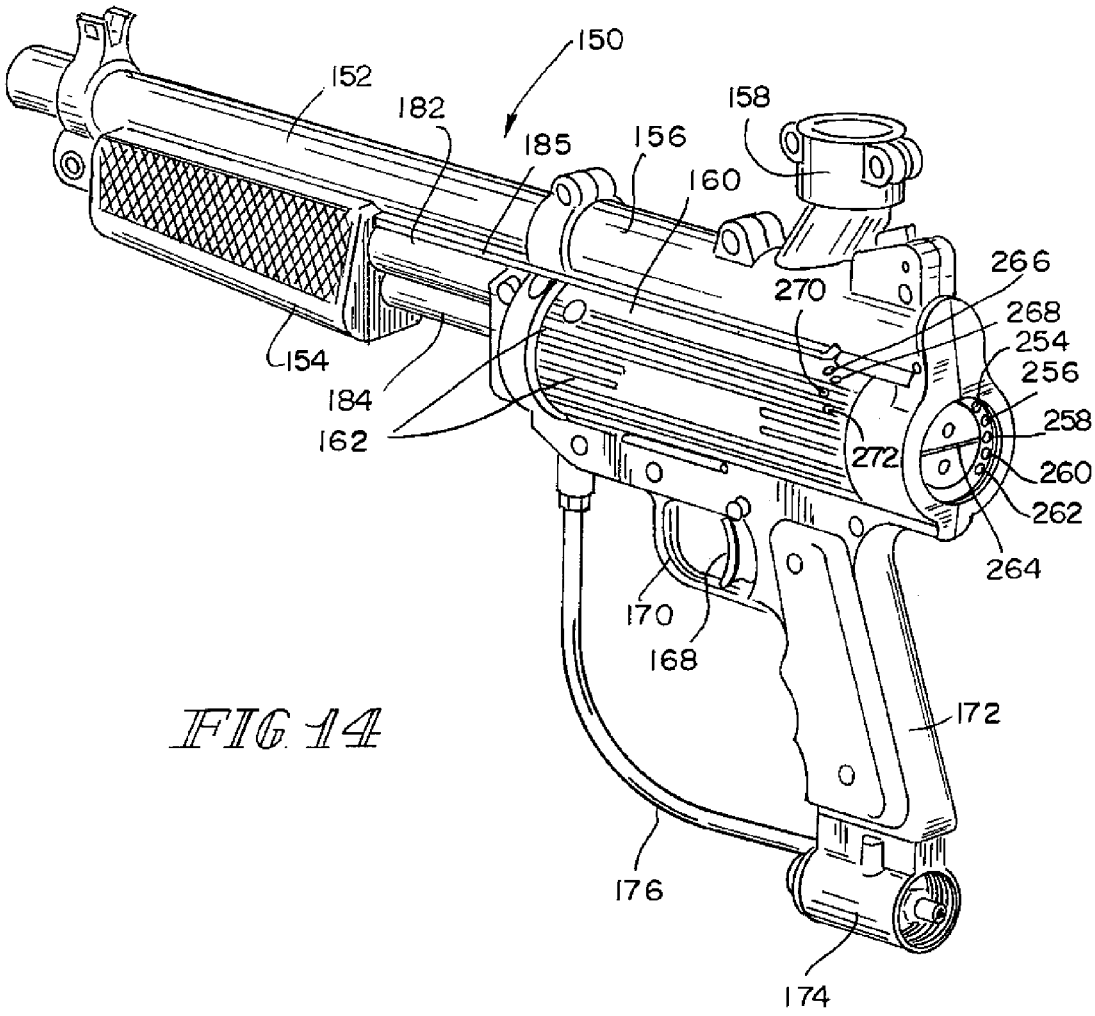
FIG. 14 is a perspective view of the embodiment shown in FIG. 10.

FIG. 14 shows a left rear perspective view of marker 150. This view shows ports 254-262, which are formed in rear member 188 and which extend into combustion chamber 160. The flow of fresh air through ports 254-262 is allowed by flexible seal 276, shown in FIGS. 13 and 13*a*. Seal 276 blocks the escape of pressurized gases through ports 254-262 following combustion. Similar ports (not shown) are located across from ports 254-262. Fresh air is drawn in through ports 254-262 and the similar ports by the vacuum created by piston 190 as it moves from right to left within combustion chamber 160. FIG. 14 also shows slot 264, which is formed in threaded plug 252. This allows a tool, such as a screwdriver, to rotate threaded plug 252 for adjusting the biasing force of spring 252.

The exemplifications set out herein illustrate embodiments of the invention in certain forms, and such exemplifications are not to be construed as limiting the scope of the invention in any manner.

Although the present invention has been described with reference to particular means, materials and embodiments, from the foregoing description, one skilled in the art can easily ascertain the essential characteristics of the invention and various changes and modifications may be made to adapt the various uses and characteristics without departing from the spirit and scope of the invention.

What is claimed is:

1. An apparatus for firing a projectile, the apparatus comprising:

a receiver including a breech portion dimensioned to receive a projectile;

a barrel coupled to the receiver, the barrel defining a longitudinally-extending axis;

a combustion chamber spaced apart from the longitudinally-extending axis;

a valve arrangement for controlling a flow of combustible gas from a supply of combustible gas to the combustion chamber;

an igniter for igniting combustible gas in the combustion chamber;

a trigger adapted to actuate the igniter; and a passageway for directing combustion gases from the combustion chamber to the breech portion.

2. The apparatus of claim 1, wherein the longitudinally-ending axis does not intersect the combustion chamber.

3. The apparatus of claim 1, wherein the combustion chamber is positioned between the breech portion and the trigger.

4. The apparatus of claim 3, wherein at least a portion of the combustion chamber is approximately laterally aligned with the trigger.

5. The apparatus of claim 4, wherein the breach portion includes an opening for receiving a projectile and wherein at least a portion of the combustion chamber is approximately laterally aligned with the opening.

6. The apparatus of claim 5, wherein an end of the passageway terminates in the breech portion approximately opposite the opening.

7. The apparatus of claim 1, wherein at least a portion of the passageway extends approximately radially from the longitudinally-extending axis.

8. The apparatus of claim 7, wherein said passageway is adapted to provide fluid communication between the combustion chamber and the breech portion.

9. The apparatus of claim 1, further comprising a movable member disposed in the passageway, wherein the movable member is movable between a first position that restricts flow through the passageway and a second position, wherein the movable member moves from the first position to the second position when a pressure in the combustion chamber reaches a predetermined level, and wherein the movable member is spaced apart from the longitudinally-extending axis.

10. The apparatus of claim 9, wherein the longitudinally-extending axis does not intersect the movable member.

11. The apparatus of claim 9, wherein the movable member is positioned between the breech portion and the trigger.

12. The apparatus of claim 9, wherein the movable member is approximately laterally aligned with a longitudinal axis of the combustion chamber.

13. The apparatus of claim 12, wherein the movable member moves in an approximately parallel but spaced apart axis with respect to the longitudinally-extending axis of the barrel.

14. The apparatus of claim 9, further comprising a spring urging the movable member toward the first position, wherein the spring is spaced apart from the longitudinally-extending axis of the barrel.

15. The apparatus of claim 14, further comprising an adjustment mechanism configured to adjust a biasing force of the spring.

16. The apparatus of claim 1, further comprising at least one vent hole for selectively venting combustion gases from the combustion chamber.

17. The apparatus of claim 16, further comprising a piston moveable to selectively open and close the at least one vent hole.

18. The apparatus of claim 17, further comprising an adjustment mechanism adapted to vary a force required to move the piston.

19. The apparatus of claim 1, further comprising a piston disposed in said combustion chamber, wherein the piston moves along an axis that is spaced apart from the longitudinally-extending axis of the barrel.

20. The apparatus of claim 19, further comprising means for preventing condensation within the barrel.

21. The apparatus of claim 19, further comprising at least one exhaust port in the combustion chamber, and wherein the piston is shaped to conform to the inner surface of the combustion chamber, such that when the piston is moved through the combustion chamber, substantially all of the gases in the combustion chamber are expelled through the exhaust port.

22. The apparatus of claim 19, further comprising a valve disposed in the piston.

23. The apparatus of claim 22, wherein the piston is movable in first and second directions within the combustion chamber, and wherein the valve allows substantially all of the gases in the combustion chamber to pass therethrough when the piston moves in the first direction.

24. The apparatus of claim 23, wherein the piston expels substantially all of the gases from the combustion chamber when the piston moves in said second direction.

25. An apparatus for firing a projectile, the apparatus comprising:

a receiver including a breech portion dimensioned to receive a projectile;

a metallic barrel coupled to the receiver, wherein an interior surface of the barrel is lined substantially with at least one of fiberglass or plastic;

a combustion chamber disposed within the receiver;

a valve arrangement for controlling a flow of combustible gas from a supply of combustible gas to the combustion chamber;

an igniter for igniting combustible gas in the combustion chamber;

a trigger adapted to actuate the igniter; and a passageway for directing combustion gases from the combustion chamber to the breech portion.

26. The apparatus of claim 25, wherein the combustion chamber comprises at least one cooling fin formed thereon.

27. The apparatus of claim 25, wherein the at least one cooling fin is longitudinally disposed on the combustion chamber.

28. The apparatus of claim 25, wherein the igniter is disposed within an opening in a sidewall of the combustion chamber.

29. The apparatus of claim 28, wherein a first portion of the receiver is disposed adjacent the opening in the sidewall of the combustion chamber, and further comprising at least one reinforcing member coupled to the first portion of the receiver and the combustion chamber.

30. The apparatus of claim 29, wherein the reinforcing member comprises at least two reinforcing clips disposed on opposite sides of the opening in the combustion chamber.

31. The apparatus of claim 30, wherein the combustion chamber comprises a plurality of cooling fins, and wherein the reinforcing member engages at least one of the fins.

32. The apparatus of claim 25, further comprising a velocity adjustment mechanism configured to adjust a velocity with which a projection is propelled out of the barrel.

33. The apparatus of claim 25, wherein the igniter is disposed in an opening in a sidewall of the combustion chamber at a location which is generally opposite to and relatively distant from the passageway.

34. An apparatus for firing a projectile, the apparatus comprising:

a receiver including a breech portion dimensioned to receive a projectile;

a barrel coupled to the receiver;

a combustion chamber disposed within the receiver;

a valve arrangement for controlling a flow of combustible gas from a supply of combustible gas to the combustion chamber;

an igniter for igniting combustible gas in the combustion chamber, wherein the igniter is disposed within an opening in a sidewall of the combustion chamber;

a trigger adapted to actuate the igniter;

a passageway for directing combustion gases from the combustion chamber to the breech portion;

at least one reinforcing member comprises at least two reinforcing clips;

wherein a first portion of the receiver is disposed adjacent the opening in the sidewall of the combustion chamber; and wherein the reinforcing member is coupled to the first portion of the receiver and the combustion chamber; and wherein the reinforcing clips are disposed on opposite sides of the opening in the combustion chamber.

35. The apparatus of claim 34, wherein the combustion chamber comprises a plurality of cooling fins, and wherein the reinforcing member engages at least one of the fins.

36. The apparatus of claim 34, wherein an interior surface of the barrel is lined substantially with either fiberglass or plastic.

37. The apparatus of claim 34, wherein the combustion chamber comprises at least one cooling fin formed thereon.

38. The apparatus of claim 37, wherein the at least one cooling fin is longitudinally disposed on the combustion chamber.

39. The apparatus of claim 34, wherein the combustion chamber comprises a plurality of cooling fins, and wherein the reinforcing member engages at least one of the fins.

40. The apparatus of claim 34, further comprising a velocity adjustment mechanism configured to adjust a velocity with which a projection is propelled out of the barrel.

41. The apparatus of claim 34, wherein the igniter is disposed in an opening in a sidewall of the combustion chamber at a location which is generally opposite to and relatively distant from the passageway.

42. The apparatus of claim 34, wherein the barrel defines a longitudinally-extending axis and the combustion chamber is spaced apart from the longitudinally-extending axis.

43. The apparatus of claim 42, wherein the longitudinally-extending axis does not intersect the combustion chamber.

44. The apparatus of claim 42, wherein the combustion chamber is positioned between the breech portion and the trigger.

45. The apparatus of claim 44, wherein at least a portion of the combustion chamber is approximately laterally aligned with the trigger.

46. The apparatus of claim 45, wherein the breach portion includes an opening for receiving a projectile and wherein at least a portion of the combustion chamber is approximately laterally aligned with the opening.

47. The apparatus of claim 46, wherein an end of the passageway terminates in the breech portion approximately opposite the opening.

48. The apparatus of claim 42, wherein at least a portion of the passageway extends approximately radially from the longitudinally-extending axis.

49. The apparatus of claim 48, wherein said passageway is adapted to provide fluid communication between the combustion chamber and the breech portion.

50. The apparatus of claim 42, further comprising a movable member disposed in the passageway, wherein the movable member is movable between a first position that restricts flow through the passageway and a second position, wherein the movable member moves from the first position to the second position when a pressure in the combustion chamber reaches a predetermined level, and wherein the movable member is spaced apart from the longitudinally-extending axis,

51. The apparatus of claim 50, wherein the longitudinally-extending axis does not intersect the movable member.

52. The apparatus of claim 50, wherein the movable member is positioned between the breech portion and the trigger.

53. The apparatus of claim 50, wherein the movable member is approximately laterally aligned with a longitudinal axis of the combustion chamber.

54. The apparatus of claim 53, wherein the movable member moves in an approximately parallel but spaced apart axis with respect to the longitudinally-extending axis of the barrel.

55. The apparatus of claim 50, further comprising a spring urging the movable member toward the first position, wherein the spring is spaced apart from the longitudinally-extending axis of the barrel.

56. The apparatus of claim 55, further comprising an adjustment mechanism configured to adjust a biasing force of the spring.

57. The apparatus of claim 34, further comprising at least one vent hole for selectively venting combustion gases from the combustion chamber.

58. The apparatus of claim 57, further comprising a piston moveable to selectively open and close the at least one vent hole.

59. The apparatus of claim 58, further comprising an adjustment mechanism adapted to vary a force required to move the piston.

60. The apparatus of claim 34, further comprising a piston disposed in said combustion chamber, wherein the piston moves along an axis that is spaced apart from the longitudinally-extending axis of the barrel.

61. The apparatus of claim 60, further comprising means for preventing condensation within the barrel.

62. The apparatus of claim 60, further comprising at least one exhaust port in the combustion chamber, and wherein the piston is shaped to conform to the inner surface of the combustion chamber, such that when the piston is moved through the combustion chamber, substantially all of the gases in the combustion chamber are expelled through the exhaust port.

63. The apparatus of claim 62, further comprising a valve disposed in the piston.

64. The apparatus of claim 63, wherein the piston is movable in first and second directions within the combustion chamber, and wherein the valve allows substantially all of the gases in the combustion chamber to pass therethrough when the piston moves in the first direction.

65. The apparatus of claim 64, wherein the piston expels substantially all of the gases from the combustion chamber when the piston moves in said second direction.

* * * * *